US008042268B2

(12) United States Patent
Arrell et al.

(10) Patent No.: US 8,042,268 B2
(45) Date of Patent: Oct. 25, 2011

(54) METHOD OF PRODUCING A TURBINE COMPONENT WITH MULTIPLE INTERCONNECTED LAYERS OF COOLING CHANNELS

(75) Inventors: Douglas J. Arrell, Oviedo, FL (US); Allister W. James, Orlando, FL (US); Anand A. Kulkarni, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 887 days.

(21) Appl. No.: 12/052,937

(22) Filed: Mar. 21, 2008

(65) Prior Publication Data

US 2009/0235525 A1 Sep. 24, 2009

(51) Int. Cl.
*B23P 15/04* (2006.01)

(52) U.S. Cl. ..... 29/889.2; 29/458; 29/527.1; 29/527.2; 165/34; 165/36; 165/516; 249/175

(58) Field of Classification Search ..... 29/889.2, 29/458, 527.1, 527.2; 165/34–36, 516–519; 249/175

See application file for complete search history.

(56) References Cited

U.S. PATENT DOCUMENTS 5,075,966 A 12/1991 Mantkowski
5,250,136 A 10/1993 O'Connor
5,465,780 A * 11/1995 Muntner et al. ..... 164/516
6,321,449 B2 11/2001 Zhao et al.
6,533,547 B2 3/2003 Andling et al.
6,582,194 B1 6/2003 Birkner et al.
6,626,230 B1 * 9/2003 Woodrum et al. ..... 164/516
6,641,362 B1 11/2003 Anding et al.
6,901,661 B2 6/2005 Jonsson et al.
6,921,014 B2 7/2005 Hasz et al.
6,951,239 B1 * 10/2005 Snyder et al. ..... 164/516
7,610,946 B2 * 11/2009 Morris et al. ..... 164/516

* cited by examiner

*Primary Examiner* — Derris H Banks
*Assistant Examiner* — Azm Parvez

(57) ABSTRACT

A method for making a gas turbine component (100). A central core (20) is positioned to occupy a space that will define a central channel (42), and an outer channel core (30) is positioned spaced apart from the central core (20). A mold (35) is formed around the central core (20) and the outer channel core (30), so that an exterior wall (32) contacts the mold (35). A substrate material, such as a metal alloy (247) in liquid form, is added to the mold (35) to form an internal volume (41) of the component (100). The central core (20) and the outer channel core (30) are removed, and interconnect channels (44) are formed between the thus-formed central channel (42) and the inner portion (49) of the outer channel (62) thus far formed. A preform (55) is placed into the inner portion (49) and may have a desired outer surface (57) shape. An overlay material is applied to form an outer layer (60), thus defining the remainder of the outer channel (62), which is obtained upon removal of the preform (55).

20 Claims, 4 Drawing Sheets

METHOD OF PRODUCING A TURBINE COMPONENT WITH MULTIPLE INTERCONNECTED LAYERS OF COOLING CHANNELS

FIELD OF THE INVENTION

The present invention relates to combustion gas turbines, and more particularly relates to a method of producing turbine components, such as blades, vanes, rings and heat shields, which have multiple and interconnected layers of cooling channels formed therein.

BACKGROUND OF THE INVENTION

Efficiency and other performance criteria are driving higher the firing temperatures of combustion gas turbines in recent years. As these firing temperatures continue to rise, so is rising the requirement to improve the cooling efficiency of the blades, vanes, and other components subjected to the heat of the combustion gases in the gas turbine (collectively, "hot gas path components").

Current firing temperatures easily are high enough to melt the metal alloys used for the hot gas path components. As a consequence of this, many such components are cooled using a gaseous cooling fluid passed through complex cooling channels within the component. The transfer of heat to the cooling medium, often compressed air or steam, cools the component. It is well known that some cooling is "open," in that some or all of the cooling fluid is released through apertures into the component into the hot gas path, while other cooling is "closed," meaning that no cooling fluid within the cooling channel system is so released.

Also, to further increase the efficiency of the cooling, a thermally insulating layer may be attached to the surfaces of the component exposed to the hot gas path or other sources of heat. The temperature gradient over this layer (one example of which is a Thermal Barrier Coating, or "TBC") is high. This allows a reduction in the amount of cooling fluid needed in the cooling channels to attain a desired cooling effect and component temperature.

Since the strength of the metal alloy comprising a component declines as temperature rises, and since there is an efficiency cost in providing cooling fluid, it is beneficial to use the flow of cooling fluid as efficiently as possible. One approach to doing this is to provide flow paths in the cooling channels that are tortuous.

This approach, however, presents a challenge in the production of complex shaped, high performance hot gas path components having such tortuous and often complex cooling channels. Providing a tortuous flow path may include providing a pattern of irregular contours in the walls of the channels. For many cooling schemes that may include complex cooling channels comprising tortuous paths to increase cooling fluid efficiency, conventional single layer cores used in casting processes are not sufficient. That is, a single central core that defines the shape of a central cooling channel in a blade or other hot gas path component does not provide a basis for forming desired multiple and complex cooling channel designs.

Thus, one current fabrication approach to achieve a desired cooling channel complexity in hot gas path components is to form molds from a series of sliding blocks. These must be separated from each other to extract the core. Using this approach to produce complex three-dimensional shapes is difficult, and many desirable forms cannot be manufactured from single cores.

To use multiple layers of cores in conventional molding is time consuming and complex. The separate layers must be manufactured individually and then assembled precisely. Examples of current approaches to molding components include U.S. Pat. No. 5,250,136, issued Oct. 5, 1993 to K. F. O'Connor, and U.S. Pat. No. 6,901,661, issued Jun. 7, 2005 to B. Jonsson and L. Sundin.

In view of the above, there remains a need in the art for a method of producing a turbine component, particularly a hot gas path component, that comprises multiple layers of cooling channels wherein the production offers production cost savings while providing for complex cooling channel features and interconnects.

BRIEF DESCRIPTION OF THE DRAWINGS

The invention is explained in the following description in view of the drawings that show.

DETAILED DESCRIPTION OF EMBODIMENTS OF THE INVENTION

The present invention relates to a method of producing turbine components that comprise multiple layers of cooling channels. Owing to the advances of this method, the components may be produced more simply and less expensively than methods that utilize complex fabrication and placement of a single core to provide multiple cooling channel layers.

The method is suitable for the manufacture of many complex cooled components, and is particularly suited for turbine blades, vanes, rings, segments, and other hot gas path components. Further, the method is well-suited for components that are thin walled, with the outer cooling channels in close proximity to the surface exposed to a heat source, such as a hot gas path. The outer wall may be formed by high velocity oxy-fuel spraying (HVOF process step) or other layer forming systems as these may be selected in embodiments of the method for particular components. As will be appreciated by the teachings herein, a two-step approach to channel formation is allowed by use of an HVOF process step, or other layer-forming process, which may be applied over a partially formed component that already has a central cooling channel formed therein. It will be appreciated that the method thus eliminates the need for complex cores placed in a mold in a single casting step.

Also, in various embodiments, the method may include steps of standard precision lost wax casting in order to form a mold and cast a central portion of the component.

Figure 1A:
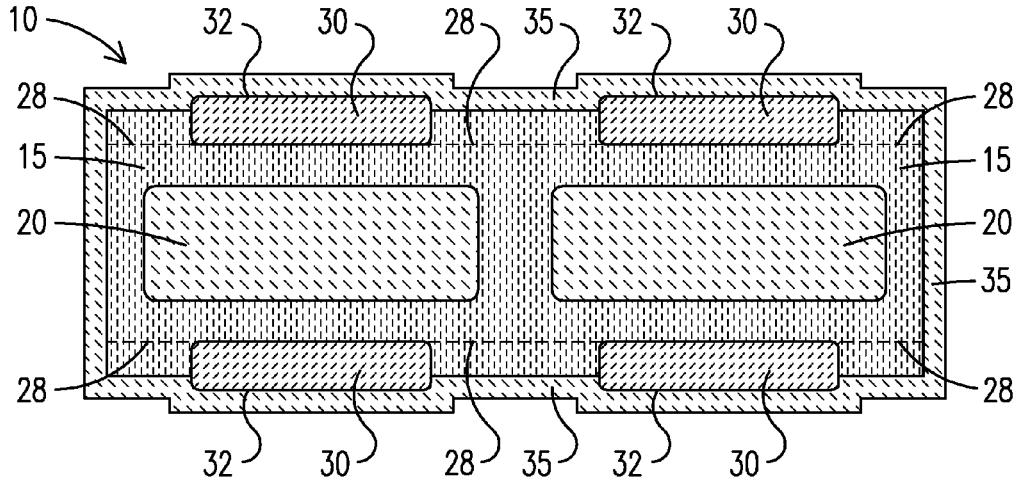
FIG. 1A depicts a schematic cross-section of a component basic form in an early stage of lost wax casting.

An understanding of the overall method, and a number of its variations, may be achieved by reference to FIGS. 1-5 and the following explanation. FIG. 1 depicts a schematic cross-section of a component basic form 10 in an early stage of lost wax casting. Two central cores 20 are positioned in a wax body 15 that conforms to a desired shape of an internal volume of a gas turbine component (the lateral sides not in detail). Four outer channel cores 30, which in various embodiments are ceramic, also are positioned in the wax body 15. Various methods of forming the wax body 15 in relation to these structures are known in the art.

Also depicted is a hardened mold 35, to reflect a standard step of immersing the component basic form 10, with central cores 20 and outer channel cores 30, or otherwise coating with, a slurry (not shown) so as to form an outer coating. It is noted that while this material often is referred to as a "ceramic" slurry, typically it is a slurry of liquid silica, which may be combined with a crystalline silica of a determined grain size. The slurry solidifies to form a hardened mold 35 whose exterior surface may be contoured as shown, or may be more uniformly linear such as if the mold 35 itself is formed in a uniform exterior form (not shown). In the embodiment of FIG. 1, an exterior wall 32 of each outer channel core 30 contacts the mold 35. While not meant to be limiting, this allows for access to the portion of the outer channel that is to be formed as a result of these steps.

Figure 1B:
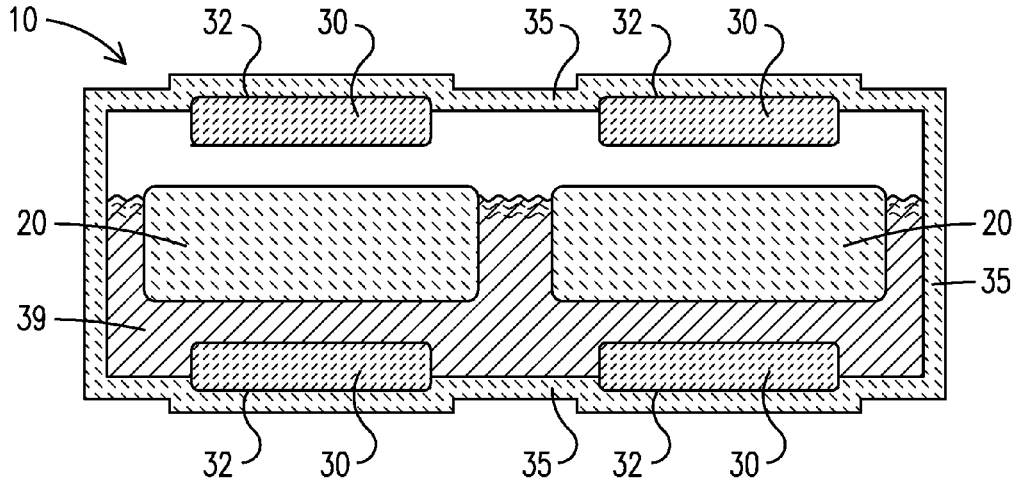
FIG. 1B depicts a schematic cross-section of the component basic form as shown in FIG. 1A in a later stage of the casting process.

Per standard techniques, the wax body 15 is removed, such as by heating while kiln drying to harden the mold 35. Then a selected substrate material 39, such as in the form of a molten metal alloy, is added into the hardened ceramic mold. This is shown in FIG. 1B (source of substrate material entering the mold not shown).

Thereafter, the central cores 20 and outer channel cores 30 are removed, such as by leaching under high pressure in an autoclave.

Figure 2:
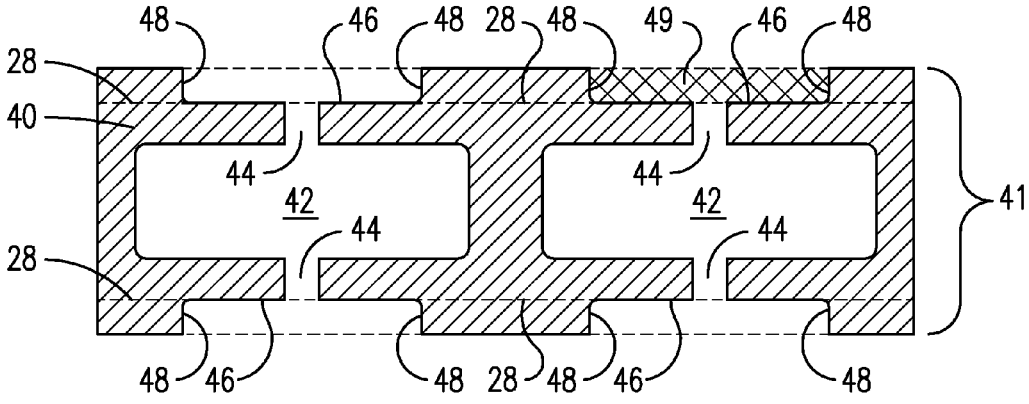
FIG. 2 provides a schematic cross-section view of a metal casting resulting from a lost wax casting processing of the form of FIG. 1.

The resulting casting 40 is shown in FIG. 2. This represents an internal volume 41 of the component being formed. Viewable in FIG. 2 are two central channels 42. These may be connected by a plurality of interconnect channels 44 that communicate with respective inner walls 46 of an outer channel (see 62 of FIG. 4) that is only partially formed at this stage. These may be formed by mechanical drilling, laser drilling, chemical milling, electro-discharge machining, inserting ceramic or glass rods during casting (or forming the cores to include rod-like protrusion), and the like.

A partial side wall 48 of the outer channel also is shown in FIG. 2. For each partially formed outer channel the inner wall 46 and the partial side walls 48 define an inner portion 49 of the outer channel being formed (shown hatched only for one of the four inner portions). However, this reflects one approach, exemplified here by providing wax (for lost wax casting) along the sides of the outer channel cores 30 as shown in FIG. 1. In other, alternative embodiments of a second approach, the wax may be formed substantially flush with the inner surfaces of the outer channel cores 30 that define the inner walls 46. This alternative is depicted with the dashed lines 28 in FIGS. 1 and 2. In such case only the inner wall 46 is defined at this stage, so that there is no volume of the outer channel yet defined. In either case, when an outer channel core is used, it may comprise protrusions (not shown in FIG. 2, but corresponding to the volume of the interconnect 44) directed toward the central core 20 so as to form all or part of the interconnects 44 (once the material of this outer channel core is removed) and/or voids or raised areas for formation of turbulators along the inner wall of the outer channel. This may increase the precision in the geometric positioning of the inner and outer cooling channels relative to each other. It also allows for the inclusion of turbulators of various types to the inner wall without the need for further machining. As used herein, a "turbulator" is any physical feature that causes turbulence to a fluid flow and so increases heat transfer, and without being limiting includes what is known in the art as a trip strip, a dimple, and a pin fin.

Other embodiments of the second approach include not providing an outer channel core 30, and forming a partial outer channel by other means, such as by mechanical and/or laser techniques.

Returning to discussion of FIG. 2, the extent of the partial side wall 48, and the inner portion 49 of the outer channel, thus may be varied over a wide range without departing from the scope of the invention. Further, as described below, in some embodiments the cast material may even extend beyond the area in which the exterior cooling channels are formed.

Figure 3:
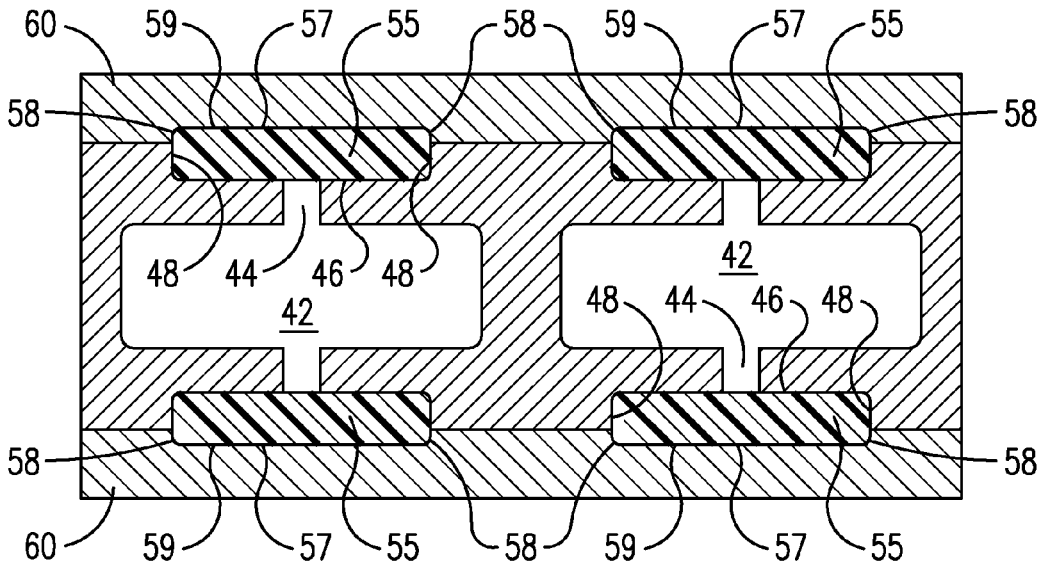
FIG. 3 depicts a later stage of the method of the present invention, building upon the metal casting of FIG. 2.

FIG. 3 depicts the next steps, and includes some identification of features already described in FIG. 2. Preforms 55 are placed into the respective inner portions 49, that is, the partially formed outer channels as defined by the respective inner walls 46 and partial side walls 48. As used herein, by "preform" is meant a preformed, such as molded, self-supporting body that may be handled and manipulated so as to fit into a desired space and orientation. In various embodiments selected outer surfaces 57 of each preform 55 comprise a desired channel detail to help achieve a desired level of perturbation or turbulence. For example, contours for turbulators (not shown here, see FIG. 5) may be formed on the exteriorly disposed outer surfaces 57 of the preforms 55, or along the inner wall 46 or the side walls' inner portions extending exteriorly from the partial side walls 48.

Examples of materials used for the preforms include ceramics, polytetrafluoroethylene, high temperature plastics, and high temperature waxes. These may be fabricated in advance, such as by molding, including extrusion molding, and then provided for use in this method. They may be molded to include keys, inserts (such as to certain interconnecting channels), and the like, so as to better assure proper placement and orientation.

With the preforms 55 so positioned to define the shape and location of the outer channels, an outer layer 60 is applied. This forms an outer covering or surface of the component being formed. The outer layer 60 may be applied as one or more layers, and is built up to cover the preforms 55. The process employed may be any thermal spray technique which does not significantly heat the casting 40 and the preforms 55, such as to their heats of deformation. Examples of thermal spray techniques that may provide such a non-destructive application of an overlay material to form an outer layer that covers the internal volume and the preform include atmospheric plasma spraying (APS), low pressure plasma spraying (LPPS), vacuum plasma spraying (VPS), twin wire arc spraying, and high velocity oxy-fuel process (HVOF). This allows relatively low melting temperature materials to be used in the preforms 55.

As briefly noted above, one such process is the high velocity oxy-fuel (HVOF) process. HVOF is a spray process in which the amount of heat transferred to the substrate (here, the casting 40 and the preforms 55) is relatively low, allowing relatively low melting temperature materials to be used in the preforms 55. The criteria for the preforms 55 is that they should not melt during HVOF spraying, but should be removable, such as by leaching (for ceramics) or heating (for polytetrafluoroethylene, high temperature plastics and high temperature waxes) after the HVOF spraying has been completed.

In various embodiments, the outer surfaces 57 of the preforms 55 have curved corners 58 as shown in FIG. 3. One performance objective for such curved corners 58 is that stress concentration does not occur at the corners formed at the interface of the casting 40 and the outer layer 60. Further, the depth of the outer channels being formed when the casting is molded (e.g., the metal replacing the wax) may be as shallow as the minimum required to form the rounded corners. In such case any remaining depth of channels may result from the sprayed outer layer 60 over the remainder of the preforms 55.

It is noted that for embodiments in which the internal volume 41 outer edge aligns along dashed line 28 (see FIGS. 1 and 2), so that only the inner wall 46 and not the partial side walls 48 are formed, the preforms 55 are placed over the respective inner walls 46 and are held in place by means known to those skilled in the art. For instance, there may be location keys, or as noted above the preforms may comprise protrusions to insert into specific interconnect channels for proper positioning (due to lack of partial sides walls 48 in such embodiments).

After application of an overlay material to form the outer layer 60, the preforms are removed. Removal may be by leaching, such as for ceramic preforms, or by heating to a sufficient temperature, such as for polytetrafluoroethylene and composites and mixed polymers made from it, high temperature plastics and high temperature waxes. In one embodiment, for example, a PTFE-based polymer, is used to mold a preform, and after application of the overlay material the component is heated to 600 degrees Celsius in air, and held at that temperature for two hours. This oxidizes and burns off the PTFE-based polymer preform material. Such sufficient temperature is greater than the temperature to which these were exposed during application of the overlay material.

For HVOF processing, the components are typically cooled during spraying to a temperature within the range of 200-300° C., which is below the melting point of the resins and polymers which would be used.

Figure 4:
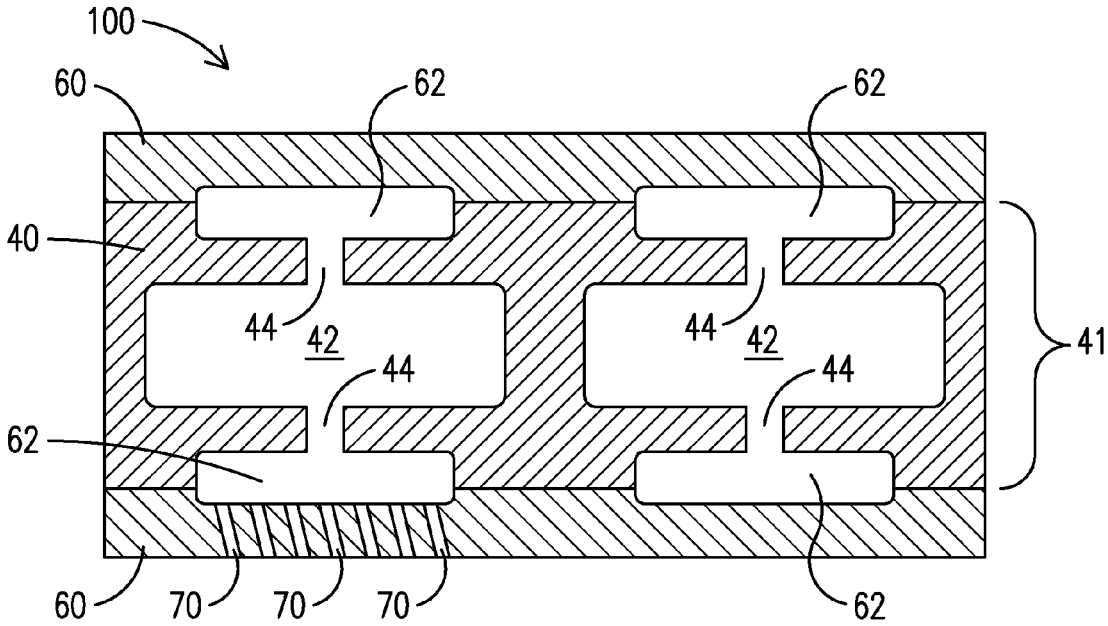
FIG. 4 depicts the component in its final form, after removal of preforms.

FIG. 4 depicts, in the same cross-section view as previous figures, and including some previously identified features, the component final form 100. Outer layers 60 are shown on the exterior, here only on a top and a bottom side (although in various embodiments the sprayed layer covers all of the exterior surface exposed to elevated temperatures). The internal volume 41 comprises the casting 40 (which may also be termed the substrate or core) within which are two central channels 42, four interconnect channels 44, and most of the volume of outer channels 62. The balance of the volume of the outer channels 62 resides in the region of the outer layers 60.

Although the above example uses an outer channel core to form an inner portion of the outer channel during the casting process, this is not meant to be limiting. For example, in some embodiments an outer channel core is not used during the casting process and at least an inner portion of the outer channel, such as its inner surface, is formed by any means known in the art, such as material removal (see Example 2, below). In various embodiments a preform then is placed into the portion formed by the removal, and the outer layer is applied as described herein so as to form the remainder of the outer channels.

It is noted that optional apertures 70 (shown only for one outer channel 62) may be provided for passage of cooling fluid from the outer channels 62 to the outside of the component 100 in open cooling approaches.

EXAMPLE 1

A turbine blade for a gas turbine engine is formed with an Alloy 247 superalloy as the base material. This material replaces the wax in a lost wax casting such as is described above. In the lost wax casting procedure, the central core is formed with a core made of a conventional core material, such as ceramic. The central core is fixed into the mold form so it does not move during the inflow of the wax or during the replacement of the wax with the Alloy 247. The outer channel core is of the same material as the central core and also is fixed, such as to the outer hardened ceramic mold.

After the Alloy 247 has hardened, the cores are removed by high pressure leaching as is known in the art of making turbine blades.

Interconnect channels are then formed, and after appropriate cleaning as needed preforms are positioned on the Alloy 247 casting, inserting into a shallow indentation formed by the outer channel cores. The preforms are made of a PTFE-based polymer and are formed by injection molding. The preforms define the outer channels to be completed by the sprayed layer.

The sprayed layer also is Alloy 247. The sprayed layer is applied by HVOF technique.

The preforms are removed by high temperature bake-out at 600 degrees Celsius for at least 2 hours The turbine blade uses the open cooling approach so some holes are formed between the outer channels and the exterior, through the sprayed layer, at predetermined locations to obtain a desired flow through the channels and along the exterior surface of the turbine blade.

EXAMPLE 2

A turbine blade for a gas turbine engine is formed with an IN 939 superalloy as the base material. This material replaces the wax in a lost wax casting such as is described above. In the lost wax casting procedure, the central core is formed with a core made of a conventional core material, such as ceramic. The central core is fixed into the mold form so it does not move during the inflow of the wax nor during the replacement of the wax with the IN 939.

In contrast to the approach of Example 1, no outer channel core is utilized while forming the inner portion of the blade. Instead, after the IN 939 has cooled sufficiently and is removed from the mold, inner walls of the outer cooling channels are manufactured by electron discharge machining (EDM) on the surface of the IN 939 casting such as by electron beam discharge machining.

Also after the IN 939 has hardened, the cores are removed by high pressure leaching as is known in the art of making turbine blades.

Interconnect channels also may be formed, and after appropriate cleaning as needed preforms are positioned on the IN 939 casting, inserting into an indentation formed by EDM process. The preforms are made of a PTFE-based polymer and are formed by injection molding. The preforms define the outer channels to be completed by the sprayed layer.

The sprayed layer is a MCrAlY bond coat known as Sicoat 2464, though any of a number of MCrAlY bond coats may be used instead. The sprayed layer is applied by HVOF technique.

The preforms are removed by high temperature bake-out at 600 degrees Celsius for at least 2 hours In this example the turbine blade uses the closed cooling approach and no holes are formed to connect the outer channels with the exterior.

Thus, it is appreciated that a step of forming an inner portion of the outer channels may be by removal of casting material, such as by EDM. Also, another variation is to form the inner wall, and optionally part or all of the side walls, as details of the wax mold, and to then to form the hardened ceramic mold (see 35 of FIG. 1) without the use of outer channel cores. This provides details of the outer channels and the latter can then be completely formed by the application of an outer layer. For example, the outer layer may be applied over an outer channel perform placed in the space provided within these details of the casting.

Also, while the embodiment described above shows outer channels formed on both sides of the inner channels, in various embodiments, such as for a heat shield, the outer channel (s) may only be formed to one side of the inner channel or channels.

Figure 5:
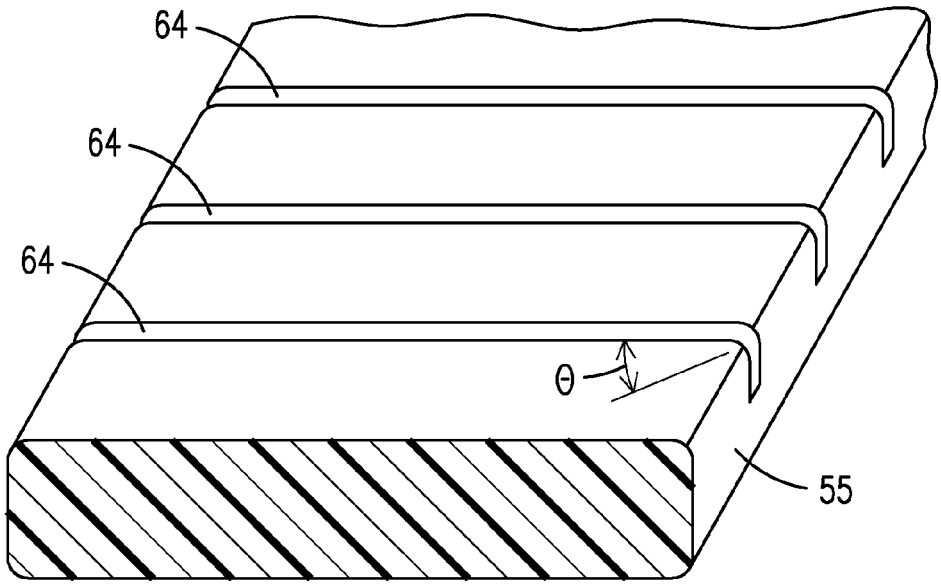
FIG. 5 provides one example of a preform, here shown with voids for provision of turbulators.

FIG. 5 depicts a preform 55 which includes outer voids 64. These may be filled by the thermal spray technique so as to form turbulator structures that increase turbulence and thus thermal conductivity within the cooling channel along the outer wall of the outer channel. As indicated above, examples of turbulators include trip strips, dimples, and pin fins. Turbulators are known in the art, such as in U.S. Pat. No. 6,641,362, which is incorporated by reference for its teachings of turbulators. It is noted that the angle of inclination of the outer voids 64 may be varied along angle θ to achieve a desired effect, including obtaining a desired perturbated flow.

Figure 6:
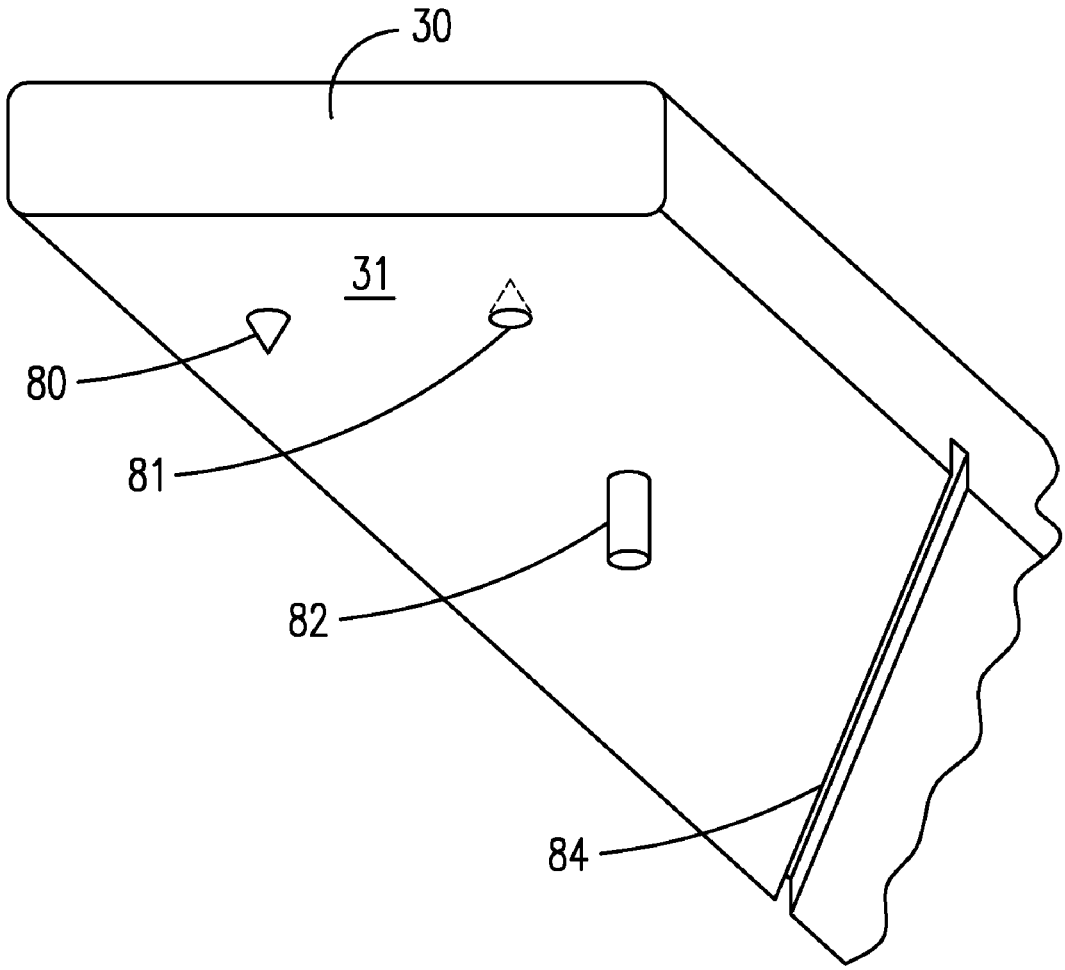
FIG. 6 provides a perspective view of a portion of an outer channel core which reveals its interior surface, showing types of features that may be found along that surface.

Also as noted above, outer channel cores may optionally comprise voids and/or raised areas to provide for turbulators along the outer channel inner wall, and may also include protrusions to form all or part of the interconnects. These optional features are shown in FIG. 6, which provides a perspective view of a portion of an outer channel core 30 that shows its interior surface 31 on which are depicted: a raised area 80 would that would form a recess-type turbulator; an inward void area 81 that would form a dimple; a protrusion 82 that would form all or part of an interconnect channel; and a slot-like inner void 84 that would form a raised fin-type turbulator. While only one of each is depicted, it is appreciated that such features would be spaced along the interior surface 31 so as to provide repetitive features.

Thus, generally, providing preforms with specific areas of roughness, turbulators, and/or contours may result in roughness and/or other features in an interior surface of the outer channel, effective to provide a non-laminar flow of fluids there through, and/or effective to provide a desired perturbated flow there through. Also, it is appreciated that through the use of the present methods an optimized cooling flow through the multi-layered channels of a component formed with the methods may be obtained.

Figure 7:
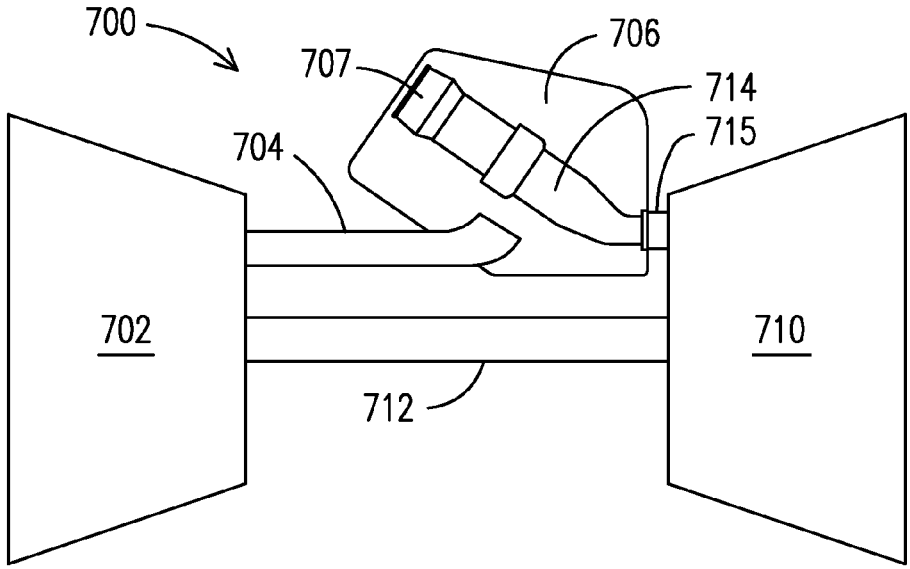
FIG. 7 is a schematic diagram of a gas turbine engine that may comprise components made by the method of the present invention.

Any of a range of hot-gas path components for a gas turbine engine may be made with the method described herein. These components are then placed into use in a gas turbine and may exhibit improved cooling properties, such as due to tortuous channels and more efficient use of compressed fluid for cooling. FIG. 7 provides a schematic cross-sectional depiction of a gas turbine engine 700 that comprises one or more components made by the method of the present invention. The gas turbine engine 700 comprises a compressor 702, a combustor 707, and a turbine 710. During operation, in axial flow series, the compressor 702 takes in air and provides compressed air to a diffuser 704, which passes the compressed air to a plenum 706 through which the compressed air passes to the combustor 707, which mixes the compressed air with fuel in a pilot burner and surrounding main swirler assemblies (not shown), after which combustion occurs in a more downstream combustion chamber of the combustor 707. Further downstream combusted gases are passed via a transition 714 to the turbine 710, which may be coupled to a generator to generate electricity. A shaft 712 is shown connecting the turbine to drive the compressor 702. In addition to turbine blade, placed in the turbine 710, the method may be used to produce vanes, rings, and heat shields in such gas turbine engine 700, which each comprises at least two interconnected layers of cooling channels.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A method for making a gas turbine component comprising:

positioning a central core to occupy a space that defines a central channel defining an internal volume of a gas turbine component;

positioning an outer channel core, spaced from the central core and defining a space, at least partially, for an outer channel;

forming a mold around the central core and the outer channel core, wherein an exterior wall of the outer channel core contacts the mold;

adding a substrate material into the mold to form the internal volume;

removing the central core and the outer channel core, thereby providing the central channel in the internal volume and an inner portion of the outer channel;

forming at least one interconnect channel connecting the central channel and the outer channel inner portion;

positioning into the outer channel inner portion a preform shaped to define at least an exterior portion of the outer channel;

non-destructively applying an overlay material to form an outer layer that covers the internal volume and the preform; and removing the preform, thereby providing the outer channel, wherein the central channel communicates with the outer channel via the at least one interconnect channel so as to provide an optimized cooling flow through the multi-layered channels.

2. The method of claim 1 wherein the preform comprises turbulators so as to provide outer channel contours providing a desired flow pattern.

3. The method of claim 1, wherein the outer channel core is positioned in the mold so that at least an inner portion of the outer channel side walls are formed when adding the substrate material into the mold.

4. The method of claim 3, wherein at least one rounded corner including a portion of the side walls is formed when adding the substrate material into the mold.

5. The method of claim 4, wherein the preform is sized so as to have a height, when positioned in the outer channel inner portion, which exceeds the height of the outer channel inner portion.

6. The method of claim 1, additionally comprising fabricating the preform, wherein the preform comprises a surface defining an outer wall of the outer channel, the surface shaped to a desired shape.

7. The method of claim 1, wherein the preform provides a desired degree of roughness in an interior surface of the outer channel, effective to provide a non-laminar flow of fluids there through.

8. The method of claim 1, wherein the preform provides an independently defined surface for contouring an interior surface of the outer channel.

9. The method of claim 1, wherein the non-destructively applying comprises a thermal spray technique selected from the group consisting of atmospheric plasma spraying (APS), low pressure plasma spraying (LPPS), vacuum plasma spraying (VPS), twin wire arc spraying, and high velocity oxy-fuel process (HVOF).

10. A method for making a gas turbine component comprising:

positioning a central core to occupy a space that defines a central channel defining an internal volume of a gas turbine component;

forming a mold around the central core;

adding a substrate material into the mold to form the internal volume;

removing the central core, thereby providing the central channel in the internal volume;

forming at least one interconnect channel connecting to the central channel;

positioning a preform, shaped to define an outer channel, onto the internal volume;

non-destructively applying an overlay material to form an outer layer that covers the internal volume and the preform; and removing the preform, thereby providing the outer channel, wherein the central channel communicates with the outer channel via the at least one interconnect channel so as to provide an optimized cooling flow through the multi-layered channels.

11. The method of claim 10, additionally comprising:

positioning an outer channel core, spaced from the central core and defining a space, at least partially, for an outer channel; and removing the outer channel core, thereby providing an inner portion of the outer channel;

wherein a portion of the preform fits into the inner portion during the positioning of the preform.

12. The method of claim 11, wherein the outer channel core is positioned in the mold so that at least a portion of the outer channel side walls are formed when adding the substrate material into the mold.

13. The method of claim 12, wherein at least rounded corner including a portion of the side walls is formed when adding the substrate material into the mold.

14. The method of claim 10, additionally comprising:

forming an inner portion of the outer channel after forming the internal volume by removing substrate material;

wherein a portion of the preform fits into the inner portion during the positioning of the preform.

15. The method of claim 10 wherein the preform comprises turbulators so as to provide outer channel contours providing a desired flow pattern.

16. The method of claim 10, wherein the non-destructively applying comprises applying the overlay material with a thermal spray technique.

17. The method of claim 10, wherein the non-destructively applying comprises applying the overlay material with a high velocity oxy-fuel process thermal spray technique.

18. A method for making a gas turbine component comprising:

positioning a central core to occupy a space that defines a central channel defining an internal volume of a gas turbine component;

positioning an outer channel core, spaced from the central core and defining a space, at least partially, for an outer channel;

forming a wax body to define a desired shape of an internal volume of a gas turbine component, wherein the wax body contains the central core and at least a portion of the outer channel core, wherein the portion comprises at least one rounded corner including a portion of a side wall of the outer channel core;

forming a mold around the wax body;

removing the wax of the wax body;

adding a substrate material into the mold to form the internal volume;

removing the central core and the outer channel core, thereby providing the central channel in the internal volume and an inner portion of the outer channel;

forming at least one interconnect channel connecting the central channel and the outer channel inner portion;

positioning into the outer channel inner portion a preform shaped to define at least an exterior portion of the outer channel, wherein the preform comprises contours effective to provide a desired perturbated flow there through;

non-destructively applying, with a thermal spray technique, an overlay material to form an outer layer that covers the internal volume and the preform; and removing the preform, thereby providing the outer channel, wherein the central channel communicates with the outer channel via the at least one interconnect channel so as to provide an optimized cooling flow through the multi-layered channels.

19. The method of claim 1 wherein the preform comprises turbulators so as to provide the desired perturbated flow.

20. The method of claim 18, additionally comprising forming in the outer channel core at least one of: a void to provide for formation of a turbulator along the outer channel interior wall; a protrusion to define all or part of the interconnect channel; and a raised area to provide for formation of a turbulator along the outer channel interior wall.

* * * * *